US006233345B1

(12) United States Patent
Urwyler

(10) Patent No.: US 6,233,345 B1
(45) Date of Patent: May 15, 2001

(54) PERSONAL EARPHONE ASSEMBLY FOR MOUNTING UPON EYEGLASSES

(76) Inventor: Peter Urwyler, 1036 Amherst Ave., Modesto, CA (US) 95350

( * ) Notice: Subject to any disclaimer, the term of this patent is extended or adjusted under 35 U.S.C. 154(b) by 0 days.

(21) Appl. No.: 09/072,660

(22) Filed: May 5, 1998

(51) Int. Cl.[7] ..... H04R 25/00

(52) U.S. Cl. ..... 381/381; 381/327; 381/330; 351/123

(58) Field of Search ..... 351/41, 158, 123, 351/111; 381/327, 330, 381, FOR 132, 374, 378; 455/344, 350, 351, 346–349

(56) References Cited

U.S. PATENT DOCUMENTS

| | | | | |
|---|---|---|---|---|
| 2,874,230 | | 2/1959 | Carlson . | |
| 3,588,384 | | 6/1971 | Negley . | |
| 4,409,442 | | 10/1983 | Kamimura . | |
| 4,538,034 | | 8/1985 | French . | |
| 4,683,587 | | 7/1987 | Silverman . | |
| 4,696,556 | | 9/1987 | Perry, III . | |
| 4,793,702 | | 12/1988 | Ahrens . | |
| 5,034,995 | * | 7/1991 | Ciccone | 455/344 |
| 5,092,668 | | 3/1992 | Welch . | |
| 5,117,465 | | 5/1992 | MacDonald . | |
| 5,151,778 | | 9/1992 | Conley . | |
| 5,164,987 | | 11/1992 | Raven . | |
| 5,367,345 | * | 11/1994 | Da Silva | 351/123 |
| 5,541,677 | * | 7/1996 | Huhtala | 351/156 |
| 5,608,808 | * | 3/1997 | Da Silva | 381/183 |

OTHER PUBLICATIONS

Peak Ski and Sport Lifestyles Magazine, Holiday Issue 1997, p. 9.

* cited by examiner

*Primary Examiner*—Huyen Le
*Assistant Examiner*—P. Dabney
(74) *Attorney, Agent, or Firm*—Joseph E. Gerber; John P. Costello

(57) ABSTRACT

This is a personal earphone assembly comprised of a flexible, elongate tube having open ends and a central lumen therethrough. Earphones are disposed at each open end of the tube, each earphone having a neck projecting therefrom and a wire passing from the neck, through the lumen, to a central aperture in the tube. In a stereophonic embodiment, the earphone wires run parallel from the central lateral aperture to a plug adapted to engage a stereo jack on a signal source. In a monaural embodiment, the earphone wires join a single double-strand lead to a mono jack. Lateral slits are provided adjacent the open ends of the tube for receipt of the temple ends of a pair of eyeglasses. The portions of the tube between the lateral apertures and the open ends wrap over and around the forward portions of a user's ear, and the earphones lodge in the outer ear canal. The assembly may also be worn without eyeglasses. In an alternative embodiment, a bead slidingly mounted on a doubled portion of the tube allows adjustment for a snug fit.

30 Claims, 7 Drawing Sheets

PERSONAL EARPHONE ASSEMBLY FOR MOUNTING UPON EYEGLASSES

BACKGROUND OF THE INVENTION

1. Field Of The Invention

The present invention relates generally to personal audio listening devices, and more specifically to assemblies wherein earphones are mounted on eyeglasses.

2. Description Of The Related Art

The miniaturization of audio signal producing devices such as radio, cassette and compact disc players has permitted users to transport these devices easily and comfortably during physical and recreational activity.

Audio devices with speakers integrated into the chassis of the apparatus generating the sound are in common use. Examples include small radios and the like, without earphones. One disadvantage of the chassis-integrated speaker is that the sound can be heard by persons other than the user, potentially disturbing such persons, and therefore limiting the usefulness of such audio players under certain conditions.

Another disadvantage of devices with chassis-mounted speakers is that the quality of the sound reaching the ears of the user can be diminished by ambient noise or wind. Consequently, for personal use, to avoid noise or wind, such devices must be held close to the ear with the hand of the user, thereby limiting the use of the hand in physical or recreational activity.

Earphone headsets for use with many different types of audio equipment are also well known. Typically such headsets include a pair of earphone speaker assemblies, one attached to either end of a flexible, generally U-shaped metal or plastic headband strip. The headset apparatus is placed on the user's head to allow the speakers to be positioned over each ear. The U-shaped headband is commonly resilient, so as to keep the speakers properly positioned over the external ears of the user. Headsets of this type are illustrated by the patents issued to Kamimura U.S. Pat. No. 4,409,442 and MacDonald U.S. Pat. No. 5,117,465.

These types of headsets have the disadvantage of becoming uncomfortable to some wearers after prolonged use. Due to the resiliency of the headband, pressure is exerted on the external ears or temples of the user by the headset causing discomfort. Such discomfort may be accentuated when the headset is used simultaneously with eyeglasses, sunglasses hats, goggles, helmets and other head-mounted gear. In many cases, awkwardness, discomfort and inconvenience cause the user to choose between the headset and the other item, as both cannot be used at the same time.

In addition, such headsets are not suitable for use during some recreational or physical activities as the sets can easily dislodge from the head of the user during these activities. Once dislodged, the headset may distract the user from the sporting or recreational activity, potentially causing a dangerous situation to the user or other participants in the activity. Such distractions may be compounded for the user who wears eyeglasses, if the eyeglasses are dislodged by, and along with, the headset.

Further, such headsets often become tangled in the hair of users with long hairstyles. Other users prefer not to have their hairstyles disturbed by the headband.

Other speaker assemblies in the art utilize the temple pieces of a pair of eyeglasses to support and position the earphone speakers. For example, U.S. Pat. No. 2,874,230 to Carlson integrates speakers into the distal ends of the temple pieces of a pair of eyeglasses. However, in Carlson, the speakers are positioned behind the external ear of the wearer, which would reduce their efficiency significantly.

U.S. Pat. No. 3,588,384 to Negley describes a combination earphone/microphone headset including a large junction block that is attached to one eyeglass temple piece by a clip. Only one earphone is provided in the Negley invention. Negley's junction block would interfere with other head-mounted apparatus such as hats, helmets and the like, and could tangle in the hair of a long-haired user.

U.S. Pat. No. 5,164,987 to Raven utilizes a pair of fiber envelopes containing speakers that are suspended from the respective temple pieces of a pair of eyeglasses. The envelopes in the Raven invention have the disadvantage of potentially obscuring the peripheral vision of some users. Further, Ravens devices are large and obvious, and likely to draw attention to the face of the user. In addition, the size and flexibility of Raven's envelopes would appear to allow the speakers to swing or flap from side to side during certain physical or recreational activities such as motorcycle riding or skiing. windy conditions may also produce such flapping. This would not only be distracting, it would interfere greatly with the volume, quality and consistency of the sound reaching the user's ears.

Other headphones known in the art utilize the elastic securing strap of a visor or goggles to secure and position the speaker assembly over the ear of the user. For example, in U.S. Pat. No. 4,538,034 to French, the strap from a visor, goggles or other headgear is used to secure the earphone assembly in close proximity to the ears. The invention in French has the obvious disadvantage of requiring that the user wear a visor or goggles before the earphone speaker assembly can be utilized. In addition, the speaker assemblies must be adjusted every time the visor or goggles are adjusted or removed.

Earphones sold as Extreme Sport Ear Phones in the Peak Ski and Sport catalog, Holiday, 1997, include individual, bendable structures which wrap around the ear and support the earphones. Although these likely keep the earphones fast to the ear during vigorous activity, they would interfere with the temple portions of eyeglasses and sunglasses.

Yet another type of personal earphone assembly in common use includes no structural mounting components at all. These earphones employ very small, padded speaker portions of the type commonly referred to as "buds," which simply lodge in the outer ear canal of the user. In stereo personal earphone assemblies employing pairs of bud-type speakers, a thin, very flexible, coated, double-strand wire runs from each bud speaker to a plug adapted to mate with a stereo jack. The wires from the two buds are usually affixed together over most of their length, from the jack plug to a point a short distance from the ends attached to the buds. There, they diverge in a Y-shaped configuration, the single wire leads being long enough to permit the buds to be placed in the ears. However, these single and double wire leads tend to flop around loosely, and are therefore very prone to getting snagged in the course of any physical activity, causing the buds to be dislodged from the ears. This is exacerbated in some constructions because, with long use, the paired wires tend to separate such that the single leads become longer and longer, creating a greater snag risk.

Thus, it appears that a need exists for a personal earphone assembly which is able to be mated securely with the ears for optimum sound quality during vigorous physical activity. But, such earphones should not interfere with glasses, hats, helmets, or goggles, and should not require goggles or a visor for support. Neither should such personal earphones be prone to getting snagged and drawn away from the user's ears during physical activity. Further, such earphones should not include components which annoy or distract the user, impair the user's vision, or draw undue attention to the user. Yet further, the earphones should not disturb a user's hairstyle, or tangle in the hair of a long-haired user.

SUMMARY OF THE INVENTION

The personal earphone assembly of the present invention is adapted to overcome the above-noted shortcomings and to fulfill the stated needs. It comprises a flexible, elongate tube with central lumen and opposed, open ends. At least one earphone is disposed at one of the tube's open ends. A wire, the distal end of which is connected to the earphone, passes into the tube's open end, through its lumen, and out through a central aperture. The proximal end of the wire includes means for connection to a signal source. The tube includes a lateral slit adjacent the open end with the earphone, the slit being dimensioned to receive the temple end of a pair of eyeglasses.

It is an object of the present invention to provide a personal earphone assembly which is convenient and comfortable to use.

It is a further object of the present invention to provide a personal earphone assembly which is easy and inexpensive to manufacture, yet durable and likely to provide a long service life.

Yet another object of this invention is to provide a personal earphone assembly which is able to mate securely with nearly any pair of eyeglasses or sunglasses, but which does not require glasses or any other support device such as a visor or goggles for effective use.

Yet a further object of the present invention is to provide a personal earphone assembly which will not interfere with a hat or helmet, or make the use of such items uncomfortable to a user.

Still a further object of the present invention is to provide a personal earphone assembly which is able to be secured to and supported by eyeglasses, but which mates securely with the user's ear canal opening.

Another object of the present invention is to provide a personal earphone assembly which employs bud-type speakers which mate with the ear canal opening, but which does not include wires which hang freely and present a risk of being snagged.

Still further objects of the inventive personal earphone assembly disclosed herein will be apparent from the drawings and following detailed description thereof.

DESCRIPTION OF THE PREFERRED EMBODIMENT

Figure 1:
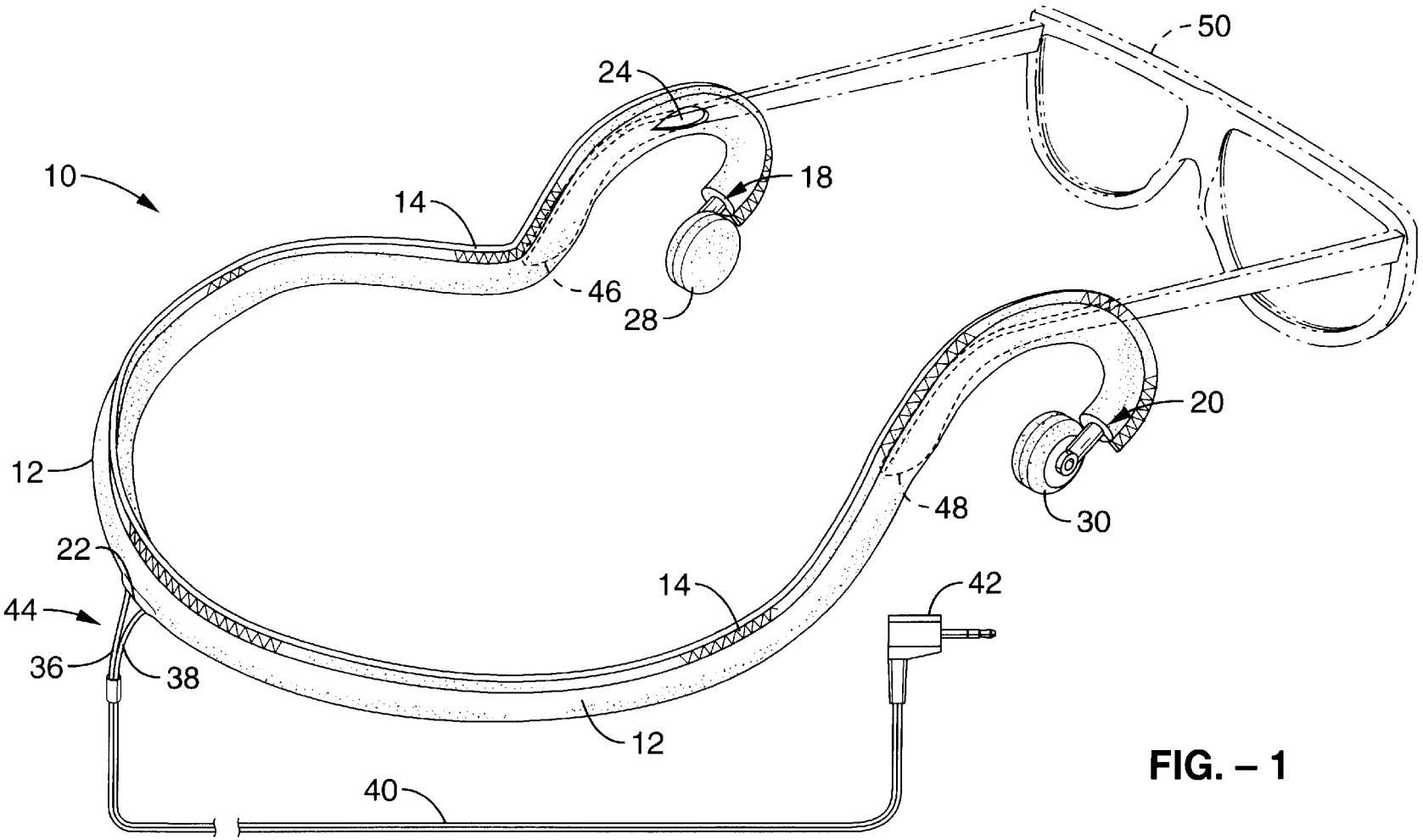
FIG. 1 is a right rear perspective view of the personal earphone assembly of the invention, engaged with a pair of eyeglasses.

Referring now specifically to the drawings, FIG. 1 shows the inventive personal earphone assembly, which is generally identified herein with reference numeral 10. Assembly 10 is comprised of an elongate, flexible fabric tube 12. Tube 12 is preferably at least 10 to 12 inches long, and in the preferred embodiment is comprised of neoprene fabric, or a similar thick, somewhat resilient fabric. Tube 12 is constructed by binding the parallel, long side edges of an elongate, rectangular neoprene strip to one another with stitched seam 14. The central bore or lumen 16 of tube 12 may have a circular or slightly flattened, oval cross section. Lumen 16 runs through the entirety of tube 12, and is contiguous with tube 12's open left and right ends 18 and 20, respectively. The width of lumen 16 is preferably 0.2 to 0.5 inches, depending on its cross-sectional configuration and the direction of measurement thereacross.

Figure 2:
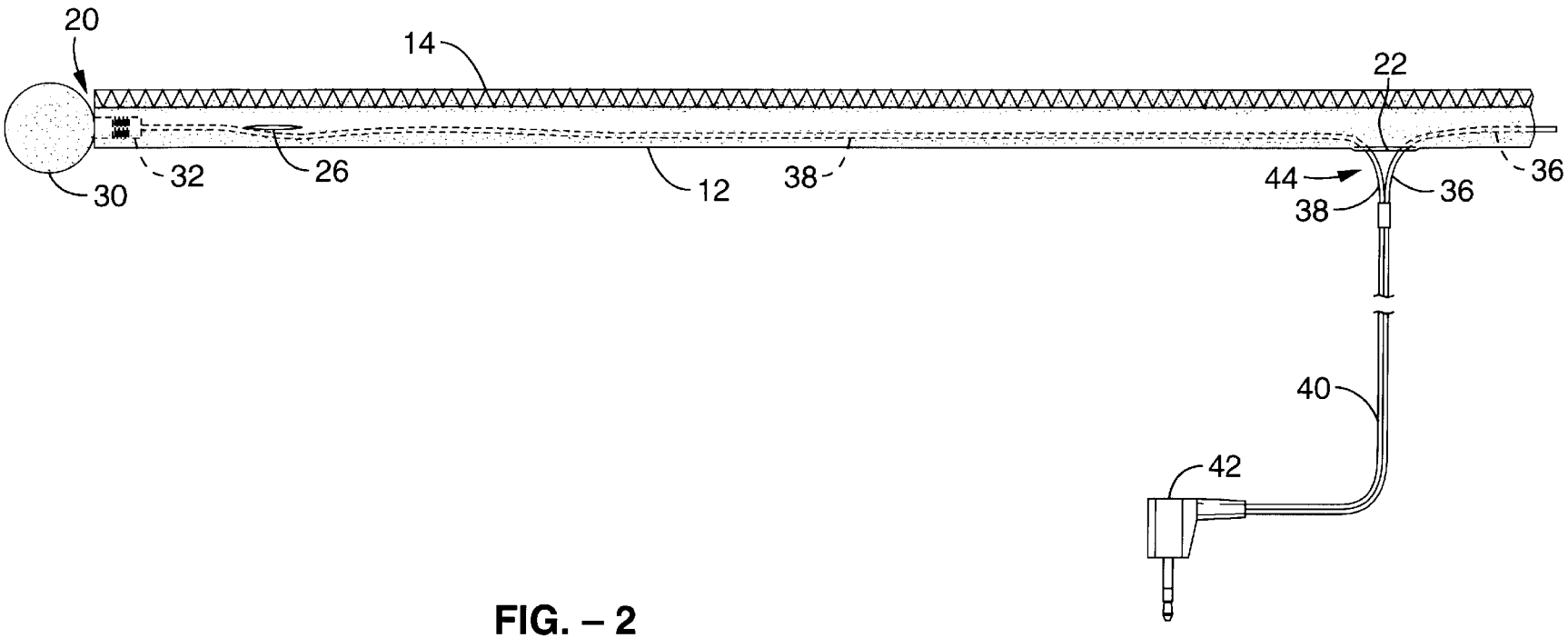
FIG. 2 is a fragmentary plan view of the personal earphone assembly of FIG. 1, showing the right side and end of the flexible tube, with its associated earphone.

As shown in FIGS. 1 and 2, tube 12 includes a central aperture 22 which opens laterally from lumen 16 roughly equidistant from left and right ends 18 and 20. Central aperture 22 is most conveniently an elongate slit approximately 0.5 inches long, oriented parallel with tube 12's long axis. Central aperture 22 is also preferably oriented opposite seam 14, i.e. with tube 12 in a linear posture, as shown in FIG. 2, in a radial plane roughly 180 degrees away from the radial plane of seam 14. The advantage of this is discussed below.

As shown in FIGS. 1–5, left and right engagement slits 24 and 26 open laterally from lumen 16, and are disposed adjacent their respective open ends 18 and 20 of tube 12. Slits 24 and 26 are preferably oriented parallel with tube 12's long axis. Each slit 24, 26 begins at a point about 1.25 inches from its respective open end 18, 20, and each slit 24, 26 extends about 0.5 inches, or so, from that point away from its respective open end 18, 20. With tube 12 in a linear posture as in FIG. 2, slits 24 and 26 are preferably oriented in the same radial plane, that radial plane being roughly 90 degrees from the plane in which seam 14 resides, and also roughly 90 degrees from the plane in which central aperture 22 resides.

Left and right earphones 28 and 30 are disposed at tube 12's left and right open ends 18 and 20, respectively. This is shown in FIGS. 1–5. Earphones 28 and 30 are of the type commonly referred to as "buds." Bud earphones have soft foam coverings and are shaped and dimensioned to lodge snugly in the user's outer ear canal. However, overall, they are generally disc-shaped, having a diameter of approximately 0.7 inches, or so. These are currently available from Sony Corporation and several other manufacturers, each manufacturer's bud earphone having a slightly different configuration. Thus, the particular bud earphone to be used in practicing the invention may be chosen, as necessary, to assure that the earphone securely engages the intended user's outer ear canal.

Figure 5:
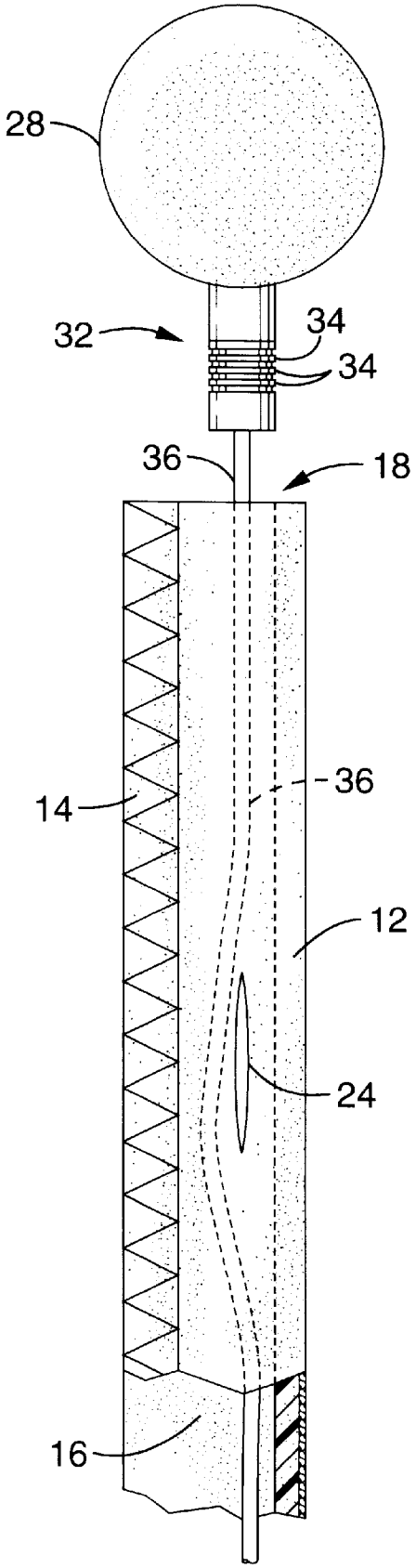
FIG. 5 is a fragmentary plan view of the left end of the flexible tube, showing the relationship of the diameter of the neck of the left earphone with the diameter of the flexible tube's lumen.

Each disc-shaped earphone 28, 30 includes rigid neck 32 projecting radially from the rigid plastic back portion thereof, i.e. from the side opposite that which engages the ear. This is best shown in FIG. 5. Neck 32 is approximately 0.6 inches long and 0.2 inches thick. At least a portion of neck 32 includes a series of projecting, circumferential ridges 34.

Earphones 28 and 30 are disposed at, and connected to, the distal ends of left and right wires 36 and 38. This is shown in FIGS. 1 through 5. Specifically, left and right wires 36 and 38 are connected to earphones 28 and 30 at their respective necks 32. Left and right wires 36 and 38 are preferably comprised of thin, flexible, coated, double-strand wire.

Figure 3:
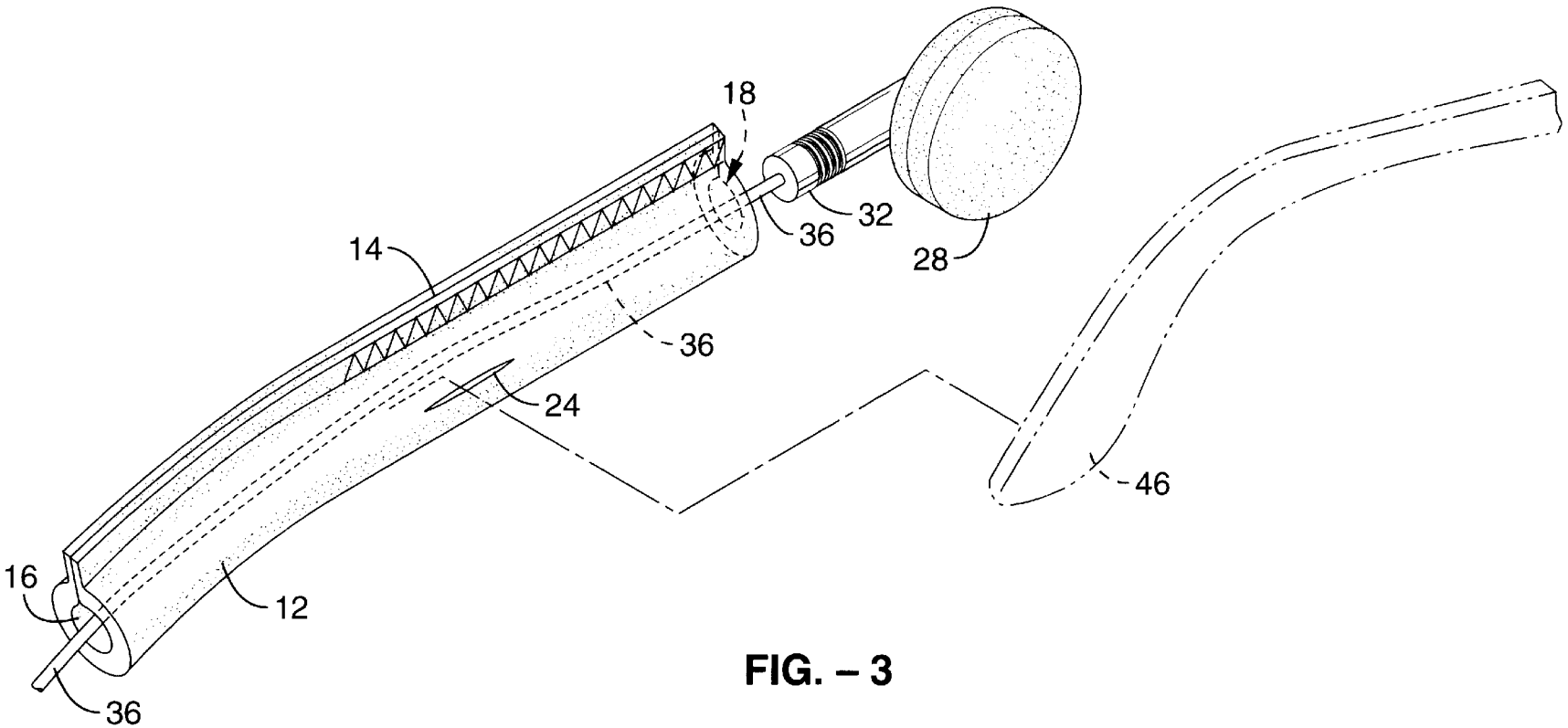
FIG. 3 is a fragmentary, right rear perspective view illustrating the manner of engaging the left end of the flexible tube with the temple end of a pair of eyeglasses.

As shown in FIGS. 3 and 5, left and right wires 36 and 38 pass into tube 12's left and right open ends 18 and 20 and, moving proximally, run coaxially with tube 12, through lumen 16 of the respective left and right portions of tube 12 between left and right ends 18 and 20, and central aperture 22. Moving farther proximally, left and right wires 36 and 38 pass laterally out of lumen 16 through central aperture 22. This is shown in FIGS. 1 and 2.

Wires 36 and 38 meet and are preferably bound together into parallel alignment forming double-wire lead 40 as they pass out of central aperture 22. Double-wire lead 40 should be roughly two to three feet long, or so. The proximal end of double-wire lead 40 is connected to a pin plug 42, or the like, able to mate with a jack of the type commonly provided on devices able to produce an audio signal. In this preferred embodiment, the plug and wire configuration is set up to carry a stereo signal; i.e. each wire 36, 38 and its respective earphone 28, 30 is a separate circuit carried through separate portions of the pin of plug 42.

However, it is also contemplated that, instead of separate circuits running from plug 42, wires 36 and 38 may be integrally joined such that they are in electrical communication with one another, forming a parallel circuit. Such may be the configuration if it is desired that a monaural signal be carried to both earphones. Such an electrical connection may be conveniently located at the Y-shaped junction 44 of wires 36 and 38, adjacent central aperture 22. Or, it may be located in plug 42.

Figure 4:
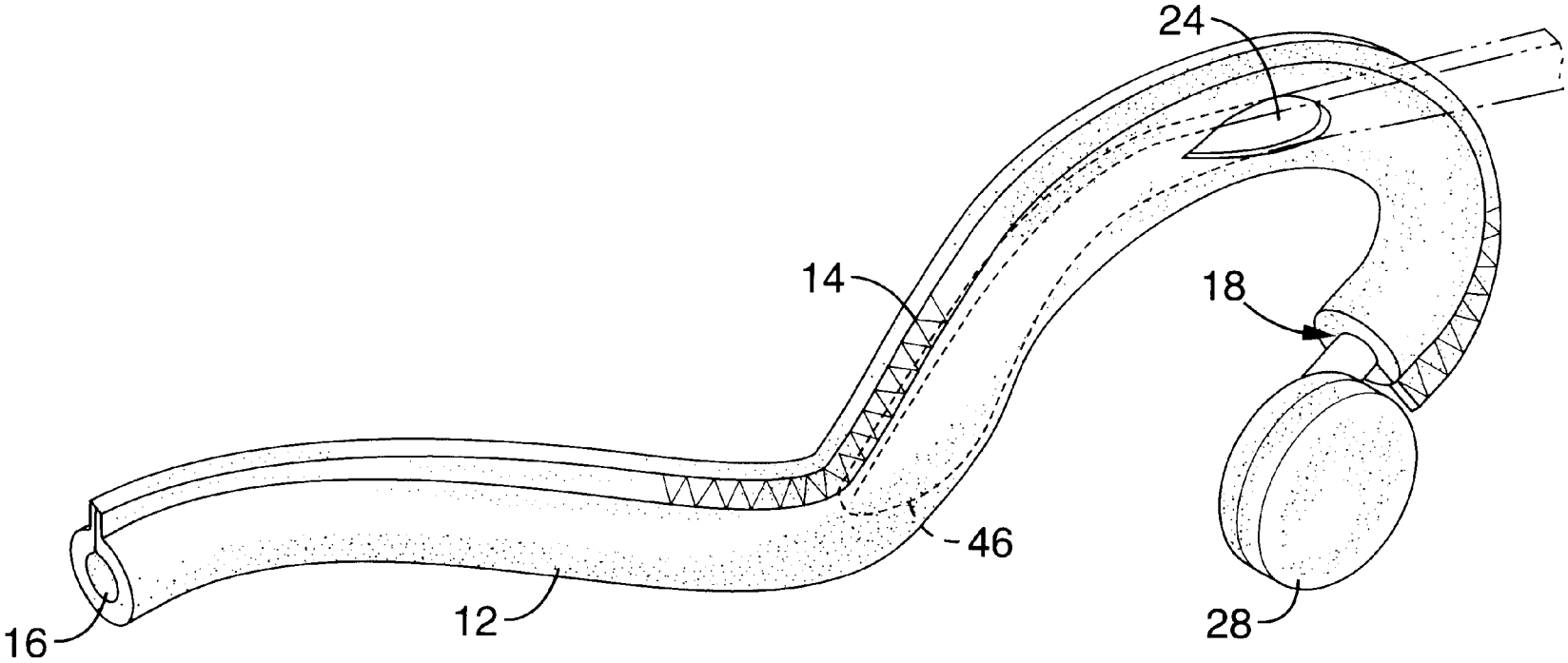
FIG. 4 is a fragmentary, right rear perspective view illustrating the completed engagement of the left end of the flexible tube with the temple end of a pair of eyeglasses.

In one mode of use, left and right temple ends 46 and 48 of a pair of eyeglasses 50 are inserted through left and right engagement slits 24 and 26 as shown in FIGS. 1, 3 and 4. Temple ends 46 and 48 are driven a substantial, but equal, distance into the central lumen 16 of the left and right portions of tube 12. Preferably, temple ends 46 and 48 are driven far enough into tube 12 such that the entire portions of temple ends 46 and 48 which curve downward and away from the horizontal are covered by tube 12. Then, eyeglasses 50 are placed on the head of the user, as they would normally be worn, with tube 12 around the rear portion of the user's head. The tube-covered portions of temple ends 46 and 48 sit atop and wrap around the rearward portions of, the user's ears. Once the foregoing elements are properly seated, left and right bud earphones 28 and 30 are snugly inserted into the outer portions of the user's left and right ear canals. Thus, the portions of tube 12 between engagement slits 24, 26 and tube ends 18 and 20 wrap comfortably and securely around the upper, forward portions of the user's ears.

The preferred arrangement discussed above regarding the disposition of seam 14, central aperture 22 and engagement slits 24, 26 in their respective radially-distinct planes 90 degrees apart assures that seam 14 will be directed upward so as not to irritate the ear and interfere with the fit of eyeglasses; that central aperture 22 will open downward to let wires 36, 38 and especially 40 hang down naturally, close to the user's head and body; and, that the end portions of tube 12 beyond engagement slits 24, 26 will hang naturally downward at the front of the ears, outside the horizontal portions of the temples, so as not to interfere with the fit of eyeglasses 50 on the user's head.

It is noted that, alternatively, if desired, left and right ends 18 and 20 of tube 12 may instead be engaged with right and left temple ends 46 and 48, respectively. However, this would cause the end portions of tube 12 to pass between the temples and the user's head, interfering with the fit of eyeglasses 50.

When arranged properly, tube 12 holds eyeglasses 50 more securely to the user's head, just by virtue of the fact that tube 12 is wrapped around the rear thereof. However, the additional fabric of tube 12 over temple ends 46 and 48 provides for a slightly more snug and secure fit for the eyeglasses, just as is needed for highly physical activities. Further, the earphones naturally hang close to the ears so that, even if temporarily dislodged by a physical blow, snagging, or the like, they remain close to the ear and easy to reinsert.

Assembly 10, as configured, also includes some adjustability to accommodate different users. This is primarily necessary in the area of the ear lobe and ear canal opening. It has been found that the distance between engagement slits 24, 26 and bud earphones 28, 30 needs to be adjustable by 0.5 inches, or so. This is accomplished by moving earphone necks 32 telescopically in or out of tube 12's ends 18 and 20. To make this most effective, the relationship between the diameter of neck 32 and the distance across lumen 16 should be such that neck 32 is able to be moved telescopically in first and second open ends 18, 20. However, ends 18, 20 of tube 12 should exert some resiliently constrictive grasp upon neck 32, and this action, in conjunction with the mechanical and frictional resistance between ridges 34 and the inner surface of tube 12 permit earphones 28, 30 to be selectively positioned closer to, or farther away from, their respective tube ends 18 and 20.

To accommodate the needed adjustability between tube ends 18 and 20 and their respective earphones, a bit of slack needs to be left at Y-shaped junction 44. That is, left and right wires 36 and 38 need to be slightly longer than their respective halves of tube 12 to avoid restricting adjustability at the wires' distal ends.

Another point of adjustment is where engagement slits 24, 26 meet temple ends 46, 48. Slits 24, 26 grasp temple ends 46, 48 somewhat resiliently, and they have the ability to stretch. Therefore, fine adjustments may be made by adjusting the depth to which a temple end is driven into the lumen 16 of its respective engagement slit. Further, slits 24, 26 can be manufactured in larger or smaller sizes to accommodate different sizes and styles of eyeglasses.

Figure 6:
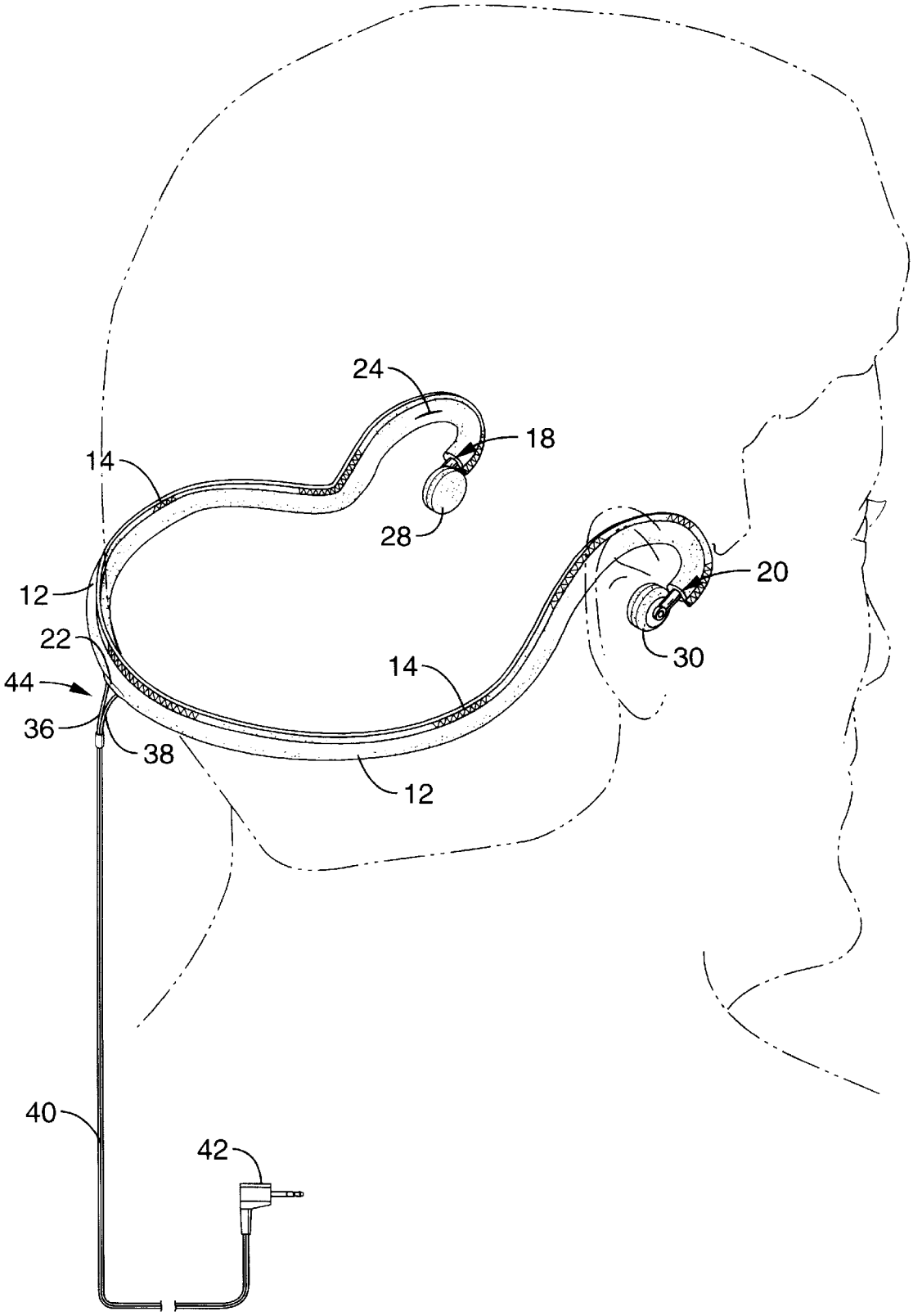
FIG. 6 is a right rear perspective view of the personal earphone assembly of the invention, illustrating self-supporting use thereof, without the aid of eyeglasses.

One alternative mode of use of the invention is to forego the engagement of tube 12 with eyeglasses. This is shown in FIG. 6. In this mode, one simply wraps tube 12 around the rear portion of the head, wraps tube ends 18 and 20 over the tops of the ears, and inserts bud earphones 28 and 30 in the outer ear canals. This is a surprisingly stable arrangement, and avoids some of the problems associated with conventional bud-type earphone sets which tend to have very long earphone leads projecting from the Y-shaped junction.

In yet another mode of use, this in connection with a slightly altered configuration for the assembly, a single earphone may be used on either the left or right side of the head. In that case, the end of the tube with the earphone would be as described; the earphone would dangle with the tube end from the horizontal portion of the temple of the eyeglasses, ready for insertion in the ear. Meanwhile, the opposing temple end of the eyeglasses could be driven into the engagement slit, or even directly into the open tube end, on the opposing end of the tube.

Figure 7:
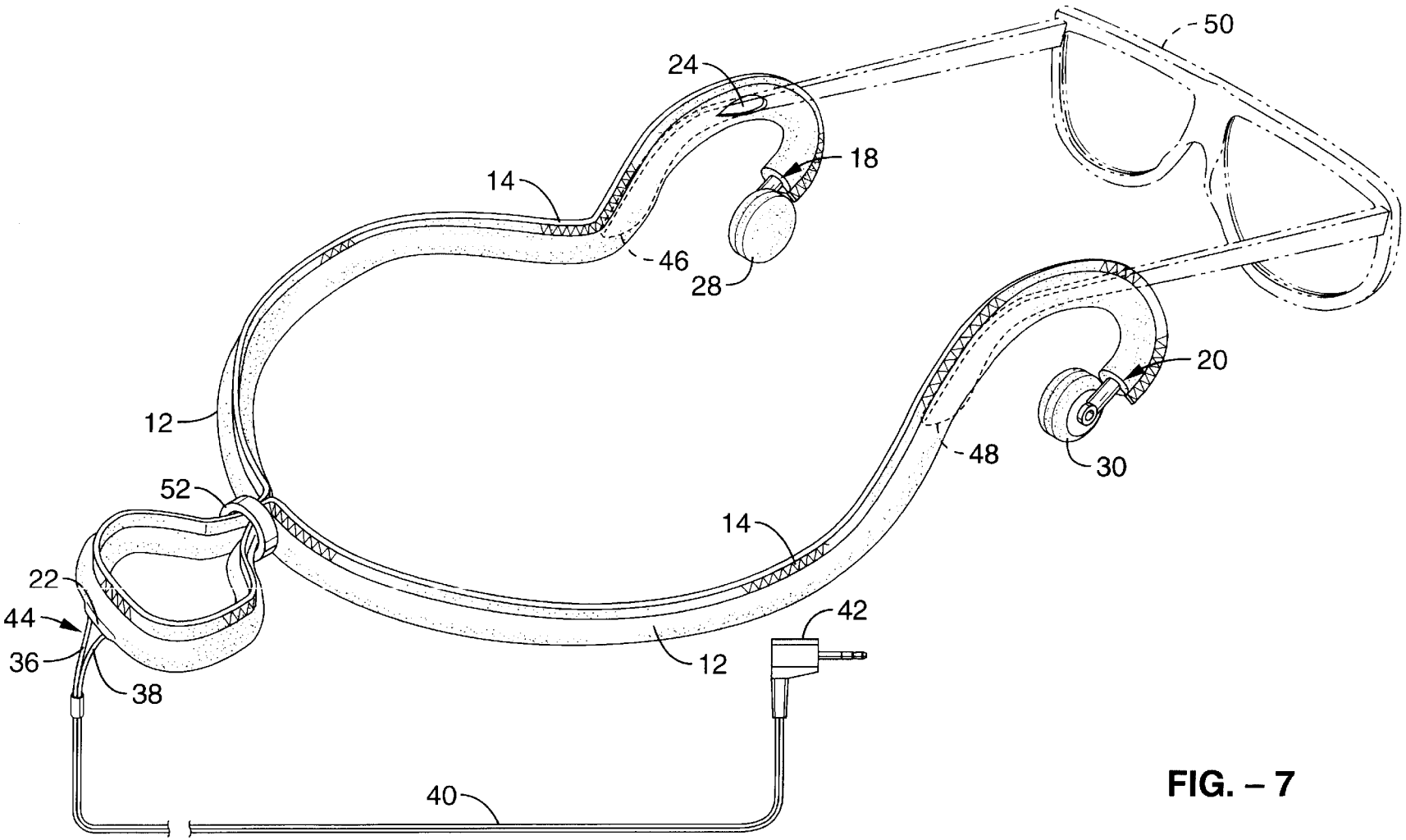
FIG. 7 is a perspective view of the personal earphone assembly of the invention, further including a snug, sliding ring for sizing the apparatus to a particular user's head.

As shown in FIG. 7, tube 12 may also be fitted with a mechanism for decreasing the effective length of tube 12, thus providing for the snuggest fit of the assembly around the rear portion of the head. Bead 52 serves this purpose. Tube 12 is folded against itself at central aperture 22 and doubled, and this doubled portion is passed through an aperture in bead 52. The aperture in bead 52 is dimensioned such that the doubled portion of tube 12 is snugly and slidably engaged therewith. As bead 52 is moved farther from central aperture 22, more of tube 12's length is doubled behind bead 52 and tube ends 18 and 20 cannot be drawn as far apart from one another. As bead 52 is cinched toward the user's head, a fit as tight as a tube 12 cut to a custom length can be achieved.

The foregoing detailed disclosure of the inventive personal earphone assembly 10 is considered as only illustrative of the preferred embodiment of, and not a limitation upon the scope of, the invention. Those skilled in the art will envision many other possible variations of the structure disclosed herein that nevertheless fall within the scope of the following claims. For example, different resilient and non-resilient tube constructions may be employed, and these may be seamed or non-seamed.

And, alternative uses for this inventive personal earphone assembly 10 may later be realized. Accordingly, the scope of the invention should be determined with reference to the appended claims, and not by the examples which have herein been given.

I claim:

1. A personal earphone assembly, comprising:

a. a flexible, elongate tube having opposed, open ends;

b. a central lumen through said tube;

c. a central aperture in said tube;

d. a first earphone disposed at a first open end of said tube;

e. a first wire, a distal end of said first wire being connected to said first earphone and passing from said first earphone into said tube's first open end, through said lumen of said tube and out through said central aperture, a proximal end of said first wire including means for connecting said first wire to a signal source; and, f. a first central slit in said tube adjacent said tube's first open end, said first central slit being dimensioned to receive a first temple end of a pair of eyeglasses.

2. The assembly of claim 1, wherein said first central aperture and said first lateral slit are disposed such that, when said tube is in a linear posture, said central aperture resides in a first radial plane and said first lateral slit resides in a second radial plane, said second radial plane being offset from said first radial plane by approximately 90 degrees.

3. The assembly of claim 1, wherein said first earphone is shaped and dimensioned to engage snugly the outer ear canal of a user.

4. The assembly of claim 1, wherein said first earphone includes a rigid neck projecting therefrom.

5. The assembly of claim 4, wherein said rigid neck is telescopically insertable in said tube's lumen, and wherein said rigid neck includes means for positioning said neck in said lumen to cause said first earphone to be selectively closer to or farther from said first tube end.

6. The assembly of claim 4, wherein said rigid neck has an outside diameter similar in dimension to the distance across said tube's lumen.

7. The assembly of claim 6, wherein said rigid neck includes ridges in its outer surface which engage an inner surface of said tube's first end and frictionally impair telescopic movement of said rigid neck to and fro in said lumen.

8. The assembly of claim 1, wherein said tube's first end is resiliently constrictive and grasps said rigid neck, frictionally impairing telescopic movement of said rigid neck to and fro in said lumen.

9. The assembly of claim 1, wherein said first wire is flexible.

10. The assembly of claim 1, wherein a portion of said tube is folded against itself and doubled, and wherein means for decreasing the effective length between said tube's ends is snugly and slidably engaged with said doubled portion of said tube such that said doubled portion passes through an aperture in said effective tube-length decreasing means.

11. The assembly of claim 1, wherein said signal source connecting means comprises a plug adapted to engage a jack of an audio signal-producing device.

12. The assembly of claim 1, further comprising:

i. a second earphone disposed at a second end of said tube;

ii. a second wire, a distal end of said second wire being connected to said second earphone and passing from said second earphone, into said tube's second open end and through said lumen of said tube, a proximal end of said second wire being in electrical communication with said first wire; and, iii. a second lateral slit in said tube adjacent said tube's second open end, said second lateral slit passing into said lumen, said second lateral slit being dimensioned to receive a second temple end of a pair of eyeglasses.

13. The assembly of claim 12, wherein said signal source connecting means comprises a monaural plug adapted to engage a jack of an audio signal-producing device.

14. The assembly of claim 1, further comprising:

i. a second earphone disposed at a second end of said tube;

ii. a second wire, a distal end of said second wire being connected to said second earphone and passing from said second earphone, into said tube's second open end, through said lumen of said tube and out through said central aperture, a proximal end of said second wire including means for connecting said second wire to a signal source; and, iii. a second lateral slit in said tube adjacent said tube's second open end, and between said second open end and said central aperture, said second lateral slit passing into said lumen, said second lateral slit being dimensioned to receive a second temple end of a pair of eyeglasses.

15. The assembly of claim 14, wherein said first wire and said second wire are bound together in parallel alignment from said signal source connecting means to a point where they pass, respectively, through said central aperture.

16. The assembly of claim 14, wherein said signal source connecting means comprises a stereo plug adapted to engage a jack of an audio signal-producing device.

17. The assembly of claim 14, wherein said first and second wires are flexible.

18. The assembly of claim 14, wherein said firt central aperture and said first and second lateral slits are disposed such that, when said tube is in a linear posture, said central aperture resides in a first radial plane and said first and second lateral slits both reside in a second radial plane, said second radial plane being offset from said first radial plane by approximately 90 degrees.

19. The assembly of claim 1, wherein said central aperture is disposed centrally in said tube's length, between said first and second ends.

20. The assembly of claim 1, wherein said first lateral slit is disposed between said tube's first open end and said central aperture.

21. A personal earphone assembly, comprising:

a. a flexible, elongate tube having opposed, open ends;

b. a central lumen through said tube;

c. a central aperture in said tube, passing into said lumen;

d. a first earphone disposed at a first open end of said tube;

e. a rigid neck projecting from said earphone, said rigid neck having an outside diameter similar in dimension to the distance across said tube's lumen;

f. ridges on an outer surface of said rigid neck, said ridges being adapted to engage an inner surface of said tube's first end and frictionally to impair telescopic movement of said rigid neck to and fro in said lumen;

g. a first wire, a distal end of said first wire being connected to said first earphone and passing from said first earphone into said tube's first open end, through said lumen of said tube and out through said central aperture, a proximal end of said first wire including means for connecting said first wire to a signal source; and, h. a first lateral slit in said tube adjacent said tube's first open end, said first lateral slit passing into said lumen, said first lateral slit being dimensioned to receive a first temple end of a pair of eyeglasses, wherein said first central aperture and said first lateral slit are disposed such that, when said tube is in a linear posture, said central aperture resides in a first radial plane and said first lateral slit resides in a second radial plane, said second radial plane being offset from said first radial plane by approximately 90 degrees.

22. A personal earphone assembly, comprising:

a. a flexible, elongate tube having opposed, open, first and second ends;

b. a central lumen through said tube;

c. a central aperture in said tube, passing into said lumen;

d. a first earphone disposed at said tube's first open end;

e. a second earphone disposed at said tube's second open end;

f. a first wire, a distal end of said first wire being connected to said first earphone and passing from said first earphone into said first open end of said tube, through said lumen of said tube and out through said lateral aperture, a proximal end of said first wire including means for connecting said first wire to a signal source;

g. a second wire, a distal end of said second wire being connected to said second earphone and passing from said second earphone, into said second open end of said tube, through said lumen of said tube and out through said central aperture, a proximal end of said second wire being connected to said signal source connecting means, said first and second wires being bound together in parallel alignment from said signal source connecting means to a point where they pass, respectively, through said central aperture;

h. a first lateral slit in said tube adjacent said tube's first open end, said first lateral slit passing into said lumen, said first lateral slit being dimensioned to receive a first temple end of a pair of eyeglasses;

i. a second lateral slit in said tube adjacent said tube's second open end, and between said second open end and said lateral aperture, said second lateral slit passing into said lumen, said second lateral slit being dimensioned to receive a second temple end of a pair of eyeglasses.

23. The assembly of claim 22, wherein said first central aperture and said first and second lateral slits are disposed such that, when said tube is in a linear posture, said central aperture resides in a first radial plane and said first and second lateral slits both reside in a second radial plane, said second radial plane being offset from said first radial plane by approximately 90 degrees.

24. The assembly of claim 22, wherein each said earphone includes a rigid neck projecting therefrom.

25. The assembly of claim 24, wherein said rigid neck is telescopically insertable in said tube's lumen, and wherein said rigid neck includes means for positioning said neck in said lumen to cause said first earphone to be selectively closer to or farther from said first tube end.

26. The assembly of claim 24, wherein said rigid neck has an outside diameter of a dimension similar to the dimension of the distance across said tube's lumen.

27. The assembly of claim 26, wherein said rigid neck includes ridges in its outer surface which engage an inner surface of said tube's first end and frictionally impair telescopic movement of said rigid neck to and fro in said lumen.

28. The assembly of claim 26, wherein said each of tube's ends are constrictingly resilient and grasps its respective said rigid neck, frictionally impairing telescopic movement of said rigid neck to and fro in said lumen of said tube.

29. The assembly of claim 22, wherein said tube is folded against itself at said central aperture and doubled, and wherein means for decreasing the effective length between said tube's ends is snugly and slidably engaged with said doubled portion of said tube such that said doubled portion passes through an aperture in said effective tube-length decreasing means.

30. A assembly for private sound reception, comprising:

a. an elongate tube having opposed, open ends;

b. a central lumen through said tube;

c. a central aperture in said tube, passing into said lumen;

d. means for converting electrical signals into sound, said signal converting means being disposed at a first open end of said tube;

e. elongate, flexible means for transmitting an electrical signal, a distal end of said signal transmitting means being connected to said means for converting electrical signals into sound, said signal transmitting means passing from said signal converting means, through said lumen of said tube and out through said central aperture, a proximal end of said signal transmitting means including means for connecting said signal transmitting means to a signal source; and, f. a lateral slit in said tube adjacent said tube's first open end, said lateral slit passing through said outer and inner surfaces of said tube to said lumen, said lateral slit being dimensioned to receive a temple end of a pair of eyeglasses.

* * * * *